US010926853B2

(12) United States Patent
Despineux et al.

(10) Patent No.: US 10,926,853 B2
(45) Date of Patent: Feb. 23, 2021

(54) DRIVE ARRANGEMENT FOR PROPELLING A BOAT

(71) Applicant: Torqeedo GmbH, Gilching (DE)

(72) Inventors: Frank Despineux, Wessling (DE); Dominik Busse, Munich (DE)

(73) Assignee: Torqeedo GmbH, Gilching (DE)

( * ) Notice: Subject to any disclaimer, the term of this patent is extended or adjusted under 35 U.S.C. 154(b) by 0 days.

(21) Appl. No.: 16/666,232

(22) Filed: Oct. 28, 2019

(65) Prior Publication Data

US 2020/0130798 A1 Apr. 30, 2020

(30) Foreign Application Priority Data

Oct. 30, 2018 (DE) ..... 102018127097.6

(51) Int. Cl.
*B63H 20/10* (2006.01)
*B63B 34/20* (2020.01)
*B63B 34/26* (2020.01)

(52) U.S. Cl.
CPC ..... *B63H 20/10* (2013.01); *B63B 34/20* (2020.02); *B63B 34/26* (2020.02)

(58) Field of Classification Search
CPC ..... B63H 21/00; B63H 21/26; B63H 20/00; B63H 20/02; B63H 20/06; B63H 20/08; B63H 20/10; B63H 5/00; B63H 5/12; B63B 34/20; B63B 34/26; B63B 35/00; B63B 35/71; B63B 2035/715
USPC ..... 440/6, 53, 55, 56, 62, 63
See application file for complete search history.

(56) References Cited

U.S. PATENT DOCUMENTS 4,713,028 A 12/1987 Duff
4,734,068 A * 3/1988 Edwards ..... B63H 20/007 440/63
5,725,401 A * 3/1998 Smith ..... B63H 20/007 440/62
8,337,266 B2 * 12/2012 Ellis ..... B63H 5/125 440/53

* cited by examiner

*Primary Examiner* — Lars A Olson
(74) *Attorney, Agent, or Firm* — Greenberg Traurig, LLP; David J. Dykeman; Roman Fayerberg

(57) ABSTRACT

The present disclosure relates to a drive arrangement for propelling a boat, for example a kayak, having an electric drive motor with a shaft, a receiving device for receiving the shaft and a holder for holding the receiving device on the boat. In some embodiments, the receiving device is pivotable for pivoting the electric drive motor between an operating position and a tilt position relative to the holder. A switchable fixing device is provided for fixing the receiving device in the operating position. The fixing device has an overload protection for disconnecting the fixing in the operating position when a predetermined pivot force in the direction of the tilt position is exceeded.

11 Claims, 13 Drawing Sheets

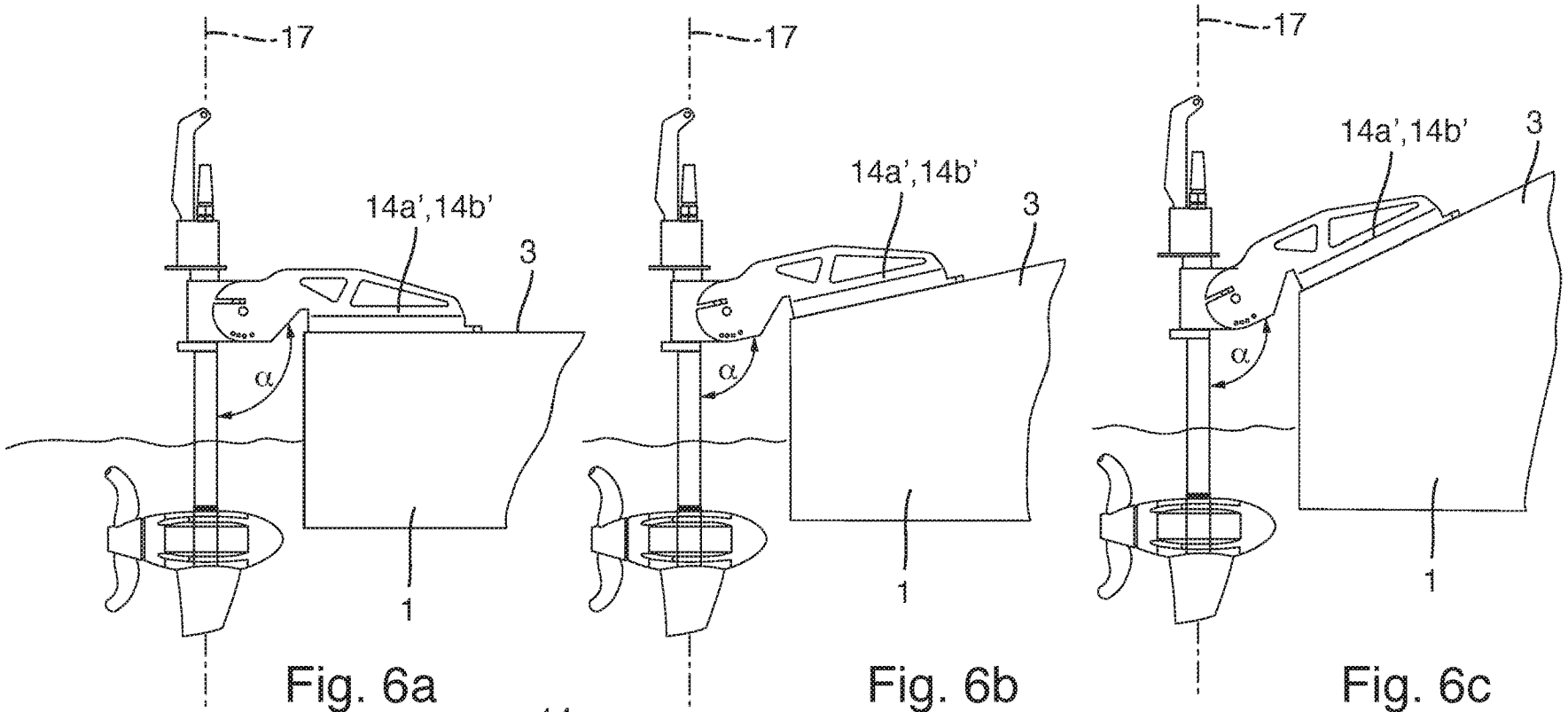
Fig. 6a
Fig. 6b
Fig. 6c
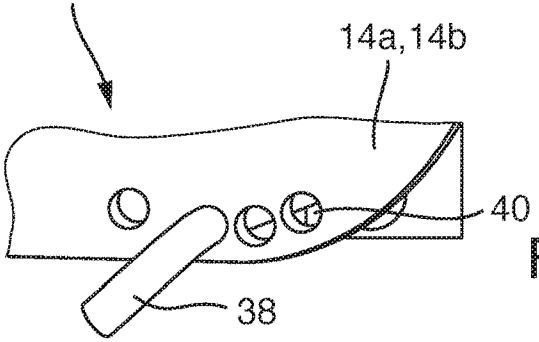
Fig. 6d

DRIVE ARRANGEMENT FOR PROPELLING A BOAT

RELATED APPLICATIONS

This application claims priority to and the benefit of German Patent Application No. DE 10 2018 127096.8, filed Oct. 30, 2018, the entirety of which is incorporated herein by reference.

FIELD

The present disclosure relates to a drive arrangement for propelling a boat, for example a kayak, as well as a boat with such a drive arrangement.

BACKGROUND

The navigation of boats in shallow water often presents a skipper with challenges. Sports fishermen in particular must often cross a broad area of relatively shallow water to reach high-yield fishing areas, which are often also located in shallow waters. The depth of the water in these shallow water areas will not always allow the safe operation of a conventional outboard engine. Contact with the ground will not only result in warping, spalling, deformation or breaking the propeller of the engine, but can also damage a shaft of the outboard engine. This can bring with it not only inconvenience connected with paddling back to the starting point, but also extremely costly repairs.

U.S. Pat. No. 4,713,028 A describes a boat that allows operation in shallow water, using an outboard engine with a propeller. The boat comprises a main skin and an adjustable transom, by device of which the engine can be lowered for normal operation and lifted for shallow water operation. Lifting the adjustable transom serves for lifting the engine and preventing damage to the propeller as well as for lifting an adjustable hull section at the same time in order to provide a flow channel for guiding water to the propeller and to the suction opening of the engine for correct and efficient cooling. Such a device does however necessitate knowing the depth of the water, i.e. the skipper must lift the engine himself by way of prevention before he navigates shallow water. Against the background that a skipper does not always know the depth of the water in areas in which he navigates or anticipates that he may be distracted whilst fishing, he will lift the engine early to prevent a collision of the engine with the ground. This device that the boat cannot always be optimally operated. The device is further adapted to a special boat configuration, which requires a device for adjusting a moveable hull section. This device can therefore not be used on boats without such an adjustable hull section.

SUMMARY

A drive arrangement is provided that reduces the risk of damaging the motor in shallow water without a skipper needing to actively intervene.

A drive arrangement is accordingly suggested for propelling a boat, for example, a kayak, having an electric drive motor with a shaft and a receiving device for receiving the shaft, wherein the receiving device is equipped for pivoting the electric drive motor between an operating position and a tilt position, and wherein a switchable fixing device for fixing the receiving device in the operating position is provided. In some embodiments, the fixing device has an overload protection for disconnecting the fixing device in the operating position when a predetermined pivot force is exceeded in the direction of the tilt position.

The fixing position is primarily used for holding the drive motor in the operating position when the drive motor applies backward propulsion to the boat. Without such a fixing device the electric drive motor would otherwise wander away from the operating position due to the applied backward propulsion and be pivoted upwards in the direction of the tilt position. A meaningful operation of the drive motor for applying backward propulsion is possible only if the drive motor is submersed in water in the operating position—this can be realized using the fixing device.

In some embodiments, apart from fixing when applying backward propulsion, fixing can also be of importance when applying forward propulsion with load changes for avoiding a vibrating of the drive motor in the receiving device or for preventing a wandering of the motor in the direction of the tilt position due to an inflow of water when a boat is not yet driving after switching off forward propulsion, and thus for reducing the noise components associated with the same, for example from a knocking of the motor or the shaft against a suspension through pendular movements.

With a rigid fixing of the drive motor in the operating position the same would however be particularly exposed to a risk of damage in shallow water areas. The fixing device is therefore a switchable design, so that the skipper can disconnect the fixing when he detects a problem or switch on the fixing only when he wishes to apply backward propulsion to the boat, or would like to suppress noise components caused by pendular movements of the motor.

It has been found that the skipper no longer needs to always actively intervene with the suggested additional overload protection to protect the propeller against a collision with the ground in shallow water.

In some embodiments, the overload protection can be designed in a way that the same allows a pivot movement of the receiving device in the direction of the tilt position from a predetermined pivot force in order to protect the propeller or another part of the drive arrangement against damage during a collision with obstacles under water. In this way the drive arrangement is automatically pivoted in the direction of the tilt position as soon as the drive motor collides with an obstacle under water with a specific force. In this way it is no longer necessary for the skipper to deal with securing the drive motor himself, for example through an early lifting or tilting of the drive motor with a rope. Further protection for the motor can be provided if the skipper is distracted when driving forwards with an unintentionally or consciously activated fixing device or overlooks an underwater obstacle. The drive motor can be optimally operated in this way.

Time, i.e. the rapid advancement through water regions in which fish can be found, is of enormous importance for sports fishermen in particular. The overload protection allows the drive motor to be left in an optimal operating position despite a collision risk with obstacles under water and a simultaneous reduction of noise components.

In some embodiments, in the tilt position, the drive arrangement is pivoted in a way that the drive motor is not submersed in water. The drive motor can be pivoted in such a way that the drive motor is arranged at approximately the same height or above a top of the boat. Accordingly, the pivot movement of the drive arrangement in the direction of the tilt position is a pivot movement that moves away from a boat end.

The overload protection can correspondingly realize a movement in the direction of the tilt position if an external force acts on the drive motor in such a way that a specific threshold value of a pivot moment is transferred to the drive motor and is exceeded in order to prevent damage to the drive motor caused by the external force.

Alternatively, the drive arrangement can also be manually pivoted into the tilt position. The drive arrangement is activated with an activation element here, for example a rope, for lifting the drive motor out of the water and for example for making the boat ready for landing or for transport.

The predetermined pivot force can also be described as a pivot moment or as an external force. The term "predetermined" relates to a device where the overload protection is triggered from a certain threshold value and allows a pivot movement in the direction of the tilt position. The threshold value is calculated in such a way that the overload protection is triggered from a pivot force that is just greater than the backward propulsion of the drive motor.

The operating position in this case device a position of the drive motor in the water for moving the boat. The shaft of the drive motor is arranged substantially vertical to the water surface. The operating position is designed in a way that forward propulsion is almost optimal with reference to maneuverability and forward propulsion in this position.

In some embodiments, the shaft can be connected with the receiving device in such a way that the shaft can be rotated around a longitudinal axis of the shaft. In some embodiments, a steering device is arranged at the upper end of the shaft.

In some embodiments, the receiving device can be pivotably connected to a holder between two holder arms of the holder in a way that the receiving device can be pivoted around a pivot axis.

In some embodiments, the receiving device can have a housing, which is fitted to the holder between the two holder arms of the holder along the pivot axis in such a way that the receiving device can be pivoted around the pivot axis. The pivot axis can be arranged vertical to a longitudinal axis of the boat and substantially parallel to a level of the top of the boat.

In some embodiments, the fixing device can have an arresting lever and an arresting bolt, wherein the arresting lever engages the arresting bolt for fixing. In this way a simple and mechanically reliable fixing of the drive motor in the operating position can be realized.

In some embodiments, a switching element can be provided and the arresting lever can be brought into engagement with the arresting bolt in such a way through activating the switching element that the receiving device is locked in the operating position, and the overload protection can be realized by designing the arresting lever in such a way that the arresting lever disconnects from the arresting bolt when a predetermined pivot force is exceeded, and the arresting lever has a correspondingly designed arresting flank that forces the arresting lever out of engagement with the arresting bolt when a predetermined pivot force is exceeded. In such a design a triggering of the overload protection can be achieved at a predetermined pivot force in a reliable way to provide a reliable operation of the drive arrangement in this way.

The drive motor can therefore be positioned in a best possible position in the operating position until the drive motor collides with an obstacle and the overload protection allows a pivot movement into the tilt position to compensate for an impact or shock to the drive motor caused by an obstacle (for example a stone) under water. After the collision with the obstacle the fixing device can be activated once more, i.e. through activating, for example through pulling the switching element.

In some embodiments, the arresting lever can be designed in a way that the arresting lever disconnects from the arresting bolt when the predetermined pivot force is exceeded and allows a pivot movement of the receiving device into the tilt position.

In some embodiments, the overload protection can have a pretensioning device for the arresting lever, and a spring element is provided and the switching element acts on the arresting lever via the spring element.

In some embodiments, an upper end of the spring element can be connected with the switching element and a lower end of the spring element can be connected with the arresting lever. The spring element can be tensioned by pulling the switching element in a way that the arresting lever arrests with the arresting bolt. The spring element can be designed in a way that the spring element is expanded further when the predetermined pivot force is exceeded and the arresting lever then disconnects from the arresting bolt. By way of example the spring element is designed as a helical spring. By selecting the spring element and the spring strength the predetermined pivot force from which the overload protection is triggered, i.e. allows the pivot movement of the receiving device in the direction of the tilt position, can thus be set in a simple and precise way.

In some embodiments, the overload protection can comprise an elastically designed arresting flank of the arresting lever, wherein the elastically designed arresting flank can be deformed in such a way when the predetermined pivot force is exceeded that the arresting lever disconnects from the arresting bolt. By way of example the arresting lever, or at least the arresting flank, can be made from a rubber-like material or from neoprene, which provides a predeterminable elasticity.

In some embodiments, the arresting lever can be moveably mounted in the housing with a bolt.

In some embodiments, a lever element can be provided, which is connected with the shaft or the receiving device in such a way that the drive arrangement can be pivoted around the pivot axis into the tilt position through activating an activation element, for example in the form of a rope. In some embodiments, the motor can thus be pivoted out of the water quickly and fixed.

In some embodiments, the drive arrangement can be moved into a transport position. The drive motor can be shifted in the direction of the end of the shaft in the direction of the receiving device in such a way that the drive motor lies as close as possible against the receiving device. The drive motor can then be pivoted away upwards from the water or earth surface. In some embodiments, the drive arrangement can be fixed for transport in this transport position. This is realized manually and can be carried out without activating a rope element. The drive motor and the boat can therefore be quickly lifted into a trailer without disconnecting the drive motor from the boat for transport. This is very important especially for sports fishermen, as competitions can be carried out across several water regions. Fast and safe transport without damage is therefore essential.

In some embodiments, the electric drive motor can have a propeller.

In some embodiments, an angle $\alpha$ between one side of a holder for holding the receiving device in longitudinal direction of the boat and the longitudinal axis of the shaft can be adjustable for setting the holder to an incline of the top of the boat in such a way that the shaft stands almost vertical in relation to a water surface. Boats, in particular kayaks, very often have no level boat ends. These usually fall in the direction of the boat end to incline in the direction of said boat end. Kayaks are mostly of a streamlined design at the boat ends to ensure that these do not generate too much resistance when submersed in water.

To guarantee an optimal position of the drive motor or the propeller the incline of the boat end can be compensated, as a right-angle arrangement between the shaft and the holder will otherwise not constitute an optimal position of the drive motor or the propeller in water. In some embodiments, the propeller is positioned such that the propeller generates propulsion of the boat with the propeller in the operating condition that is substantially parallel to the water surface.

In some embodiments, a fixable joint can be arranged between shaft and motor. In some embodiments, the shaft and the holder can be arranged at right angles to each other. Such a right-angled arrangement would lead to a mispositioning of the drive motor in the water without the joint (the direction of the propeller propulsion would not extend parallel to the water surface in most installation cases), which can be compensated by the joint between shaft and motor to align the propeller propulsion parallel to the water surface.

In some embodiments, a joint is provided between motor and shaft in addition to the angle adjustment between the holder and shaft, so that the skipper has two adjustment possibilities to optimally adapt the propeller propulsion to the incline of the top of the boat end. The drive arrangement can therefore be adapted to many boats with different inclines of the boat ends.

In some embodiments, the holder has at least one recess in a holder arm, and a trim stud is provided on the housing of the fixing device for engaging the at least one recess.

In some embodiments, several recesses are arranged in a way that the angle $\alpha$ between the side of the holder in longitudinal direction of the boat and the shaft is adjustable through adjusting the trim bolt in one of the recesses for angle $\alpha$ to be set.

In some embodiments, angle $\alpha$ is adjustable within an angle range of between 80° and 120°, preferably 90°-114°.

In some embodiments, a boat, for example a kayak, with a drive arrangement is provided. The boat has a fitting area on a top of one boat end, on which the drive arrangement can be fitted to the boat. In some embodiments, the fitting area is simultaneously a device for fitting an anchor.

In some embodiments, the drive arrangement can provide protection against the overloading of the drive motor through collision with obstacles under the water surface. The drive motor can be damaged during collisions with obstacles.

The fact that the overload protection automatically allows a pivot movement from a certain threshold value of the collision shock in the direction of the tilt position can dampen the effect of the collision. One advantage is that the skipper does not need to preventatively lift the motor to avoid a collision. A further advantage is that the efficiency of the motor is improved, as the motor remains in the optimal operating position until the time of collision. In this way the boat can always be operated with optimal forward propulsion features, which is of great importance in particular for sports fishermen. The holder in the boat is further structured in such a way that the same can be suspended from or fitted to different boats.

Further advantages and characteristics of the present disclosure are clear from the following description of embodiment examples. The characteristics described therein can be implemented independently or in combination with one or more of the characteristics illustrated above as long as the characteristics do not contradict each other. The following description of embodiment examples relates to the accompanying drawings.

BRIEF DESCRIPTION OF THE DRAWINGS

The present disclosure is further described in the detailed description which follows, in reference to the noted plurality of drawings by way of non-limiting examples of exemplary embodiments, in which like reference numerals represent similar parts throughout the several views of the drawings, and wherein:

FIGS. 6A, 6B, 6C, and 6D are schematic views of the drive arrangement in different holder positions on different boats.

DETAILED DESCRIPTION

Embodiment examples are described as follows with reference to the figures. Identical, similar or identically acting elements in the various figures are identified with identical reference numbers and a repeated description of these elements is omitted in part to avoid redundancies.

Figure 1:
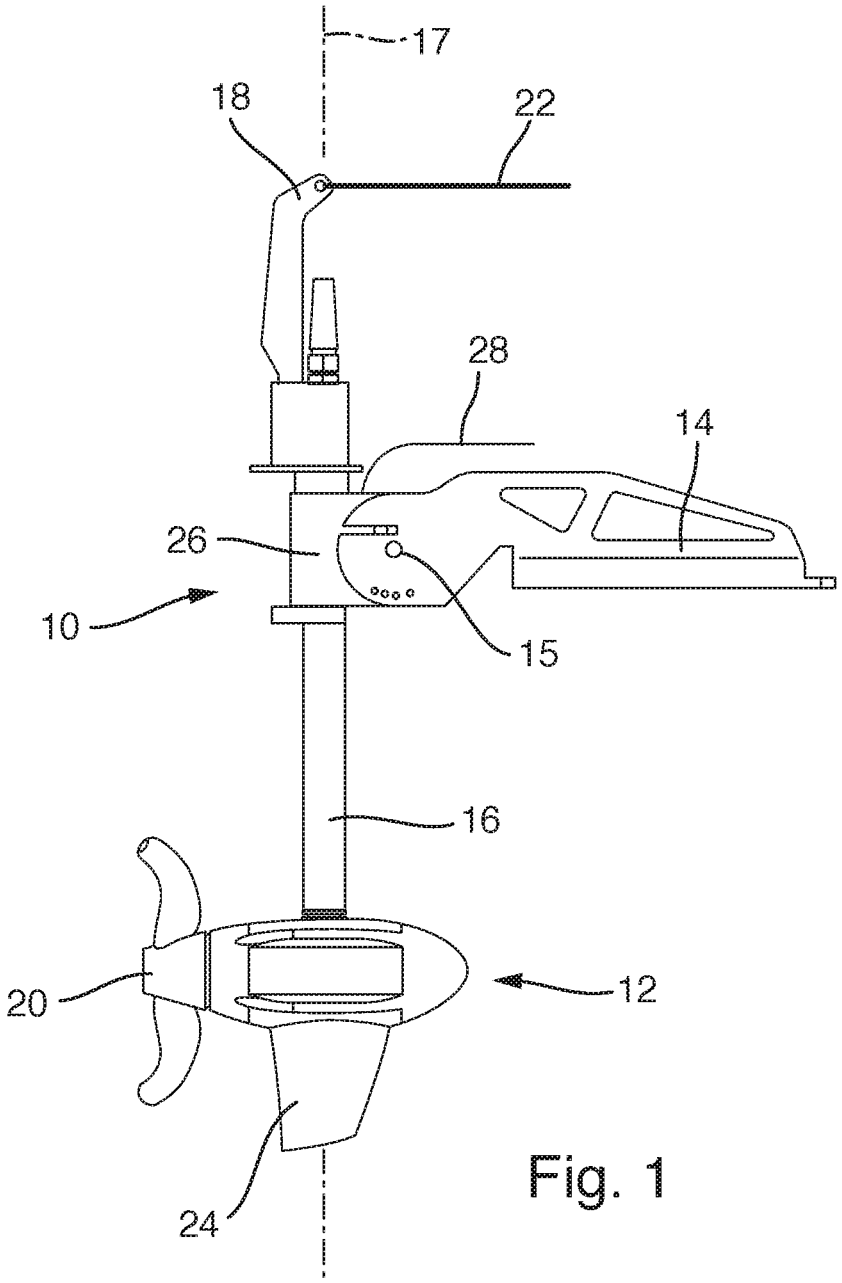
FIG. 1 is a schematic side view of a drive arrangement according to some embodiments.

FIG. 1 shows a schematic side view of a drive arrangement 10 for propelling a boat, in particular a kayak.

The drive arrangement 10 has an electric drive motor 12 with a shaft 16, a receiving device 26 for receiving the shaft 16, and a holder 14 for holding the receiving device 26 on the boat.

Figure 3A:
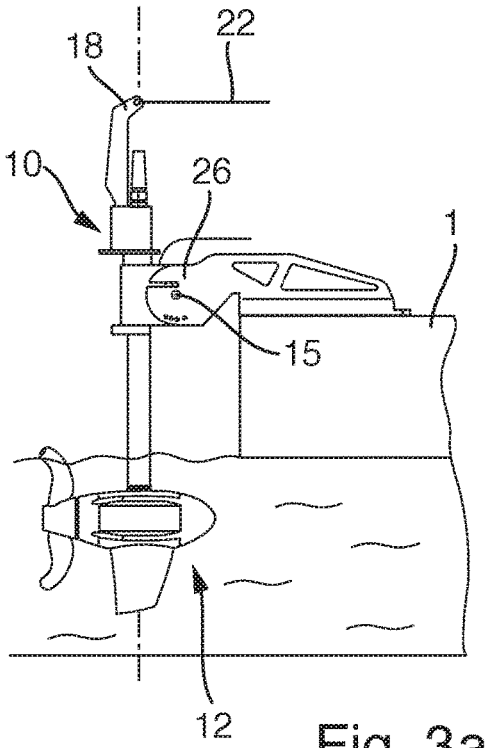
FIGS. 3A, 3B, and 3C are schematic side views of the drive arrangement of the preceding figures, wherein the drive arrangement is schematically shown in an operating position, a tilt position and in an interim position.
Figure 3B:
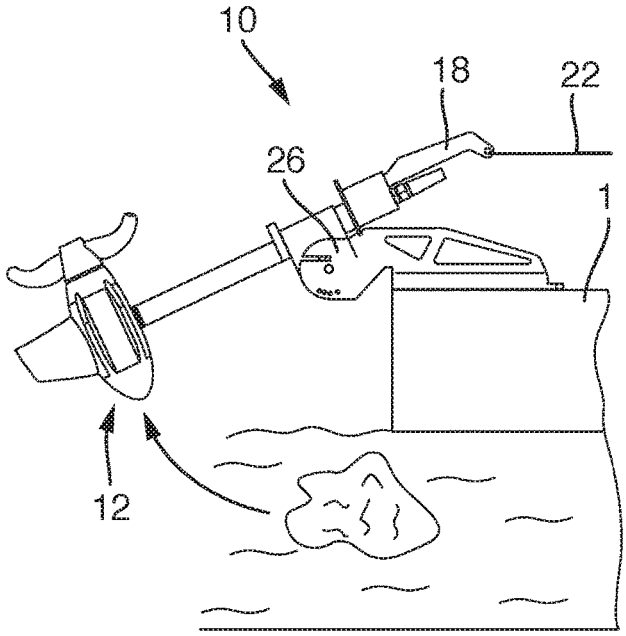
Figure 3C:
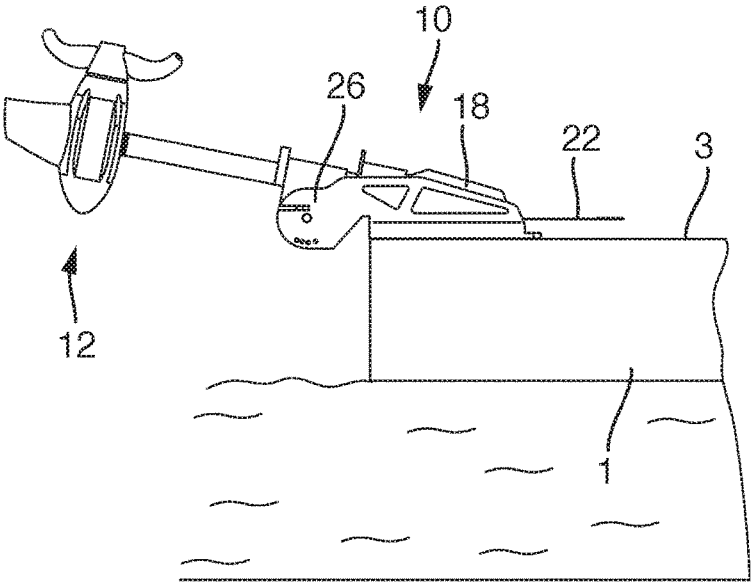

The receiving device 26 is pivotable between an operating position, which is shown in the present figure, and a tilt position, which is for example shown in FIG. 3C, relative to the holder 14 for pivoting the electric drive motor 12. In this way the drive motor can be quickly pivoted out of the water and fixed.

A particularly easy transport and a particularly easy lowering into the water and raising out of the water of the kayak can thus be realized especially when the drive arrangement 10 is fitted on a kayak in that the drive motor 12 is held in the tilt position.

In some embodiments, a switchable fixing device 28 is provided for fixing the position of the electric drive motor 12 in the operating position. The fixing device 28 not only applies propulsion directed in a forward direction to the kayak by means of the electric drive motor 12 pivotably received in the receiving device 26, but also propulsion directed in a backward direction. The pivotability of the electric drive motor 12 from the operating position into the tilt position would otherwise cause a pivoting of the electric drive motor 12 in the direction of the tilt position as soon as propulsion directed in a backward direction is applied by device of the electric drive motor 12. In other words, the switchable fixing device is of importance for allowing an operation of the electric drive motor 12 in all propulsion directions and for transferring this propulsion to the kayak as well.

During operation with forward-directed propulsion, the switchable fixing device 28 does not need to be switched to allow operation. Instead it is the case that a skipper will typically activate the switchable fixing device 28 only before he intends to activate the electric drive motor 12 with backward-directed propulsion. This switching for example takes place through activating the switchable fixing device 28 and with a corresponding pulley.

The fixing device 28 also prevents pendular movements and a vibration of the drive motor 12 during load changes.

In some embodiments, the fixing device 28 has an overload protection 300 for disconnecting the fixing device when a predetermined pivot force in the direction of the tilt position is exceeded. The skipper therefore does not need to actively intervene to protect the drive motor against damage. The overload protection 300 can be designed in a way that the same allows a pivot movement of the receiving device 26 in the direction of the tilt position from a predetermined pivot force for protecting the propeller or another part of the drive arrangement against damage during a collision with obstacles under the water. In this way, a pivotability of the electric drive motor 12 in the direction of the tilt position is released as soon as the drive motor 12 collides with an obstacle with a specific external force in forward direction of the boat. This means the skipper no longer needs to deal with securing the drive motor 12 himself, for example through early lifting. The drive motor 12 can therefore be optimally operated.

Setup time is of enormous importance, in particular for sports fishermen. The overload protection 300 allows a continuous operation of the drive motor 12 despite a risk of collision with obstacles under the water in an optimal operating position.

Figure 2A:
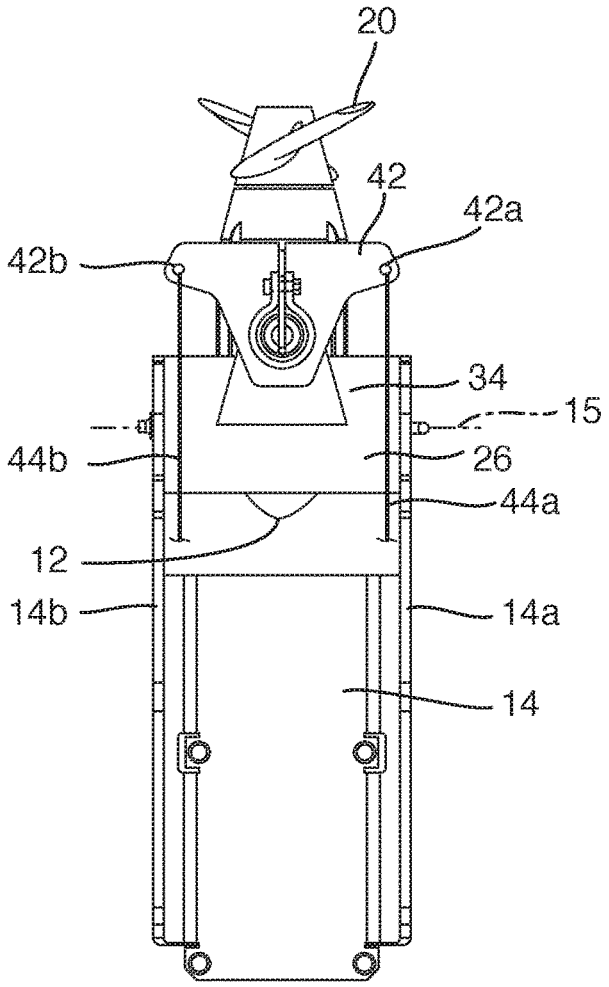
FIG. 2A and FIG. 2B illustrate schematic top views of the drive arrangement of FIG. 1, wherein the propeller is shown pivoted in different directions.
Figure 2B:
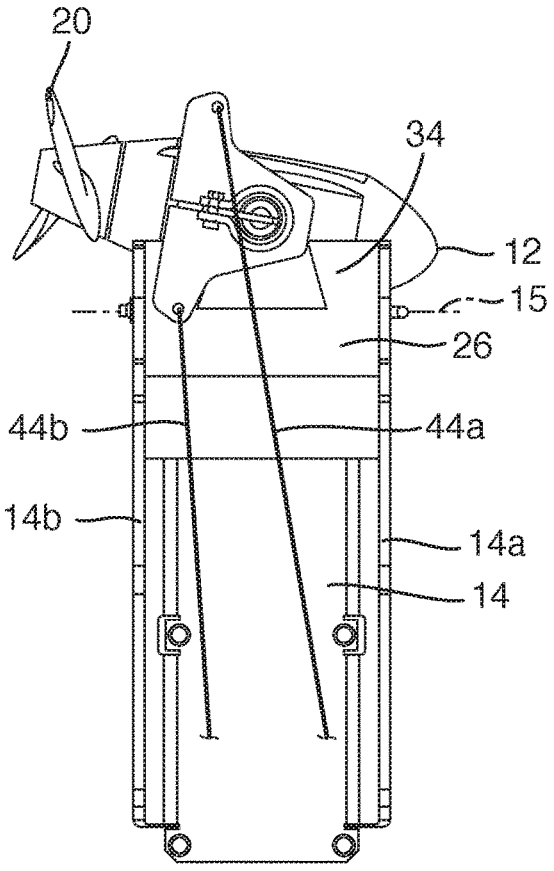

FIGS. 2A-2B show by way of example how the shaft 16 is connected with the receiving device 26 in a way that the shaft 16 can be rotated around a longitudinal axis 17 of the shaft 16 for steering the boat by device of a corresponding alignment of the propulsion. A steering device 42 is also arranged at the upper end of the shaft. In some embodiments, the steering device 42 for example has a steering triangle with two legs 42*a*, 42*b* protruding outwards from the shaft. In a straight-ahead positioning of the drive motor 12 the legs are arranged on the shaft in a way that they are positioned in a direction that is parallel to a transom of the boat. One leg is arranged on the left side of the shaft and another leg on the right side of the shaft. A steering element 44*a*, 44*b* each, for example a rope or a wire, is fitted to the legs. The shaft can be rotated around the longitudinal axis into a first or second direction through activating one of the two steering elements to steer the boat.

Pulling the steering element 44*b* forwards is shown by way of an example in FIG. 2B, which has the consequence that the drive motor is rotated in a counterclockwise direction. The steering elements can for example be guided along a longitudinal direction of the boat in a foot-well of the boat (not shown), wherein the two steering elements are fitted to at least one activation element. In some embodiments, the two steering elements 44*a*, 44*b* can be activated by means of a pedal each for steering the boat. As shown in FIGS. 2A-2B, the drive motor can be rotated up to 90° to the right or left.

In some embodiments, the receiving device 26 can be pivotably connected with the holder 14 between two holding arms 14*a*, 14*b* of the holder 14, so that the receiving device 26 can be pivoted around a pivot axis 15. In some embodiments, the electric drive motor 12 has a propeller 20. In a further example the receiving device 26 has a housing 34, which encases the receiving device 26 and is fitted to the holder 14 between the two holding arms 14*a*, 14*b* of the holder 14 along the pivot axis 15 in such a way that the receiving device 26 can be pivoted around the pivot axis 15. The pivot axis is vertical to a longitudinal axis of the boat and substantially parallel to a plane of the top of the boat. The housing 34 is designed in a way that it surrounds the shaft 16 and provides a rotatable mounting of the shaft 16 in this way, and simultaneously transfers the pivot movement of the receiving device 26 to the shaft 16 in the direction of the tilt position. In some embodiments, a slide bearing 33 (FIG. 5A) is provided between the shaft 16 and the housing.

FIGS. 3A-3C show the drive arrangement 10 in different position conditions. FIG. 3A shows the drive arrangement in the operating position. The operating position relates to a position of the drive motor in the water for moving the boat. The shaft of the drive motor is arranged substantially vertical to the water surface. The operating position is designed in a way that forward propulsion is the most optimal in this position with regard to maneuverability and forward propulsion. During forward travel the drive motor 12 is pushed into the operating position by the propulsion generated by the same and is then located at a stop that is predetermined by the receiving device 26 at the end of a pivot movement.

If the drive motor is switched free of propulsion or if the drive motor is switched to backwardly directed propulsion, an activation of the switchable fixing device 28 will prevent a pivoting of the drive motor in the direction of the tilt position. Fixing the drive motor 12 by means of the switchable fixing device 28 therefore serves for holding the motor stable in the water and for avoiding reeling movements of the drive motor 12 caused by inflowing water (schematically indicated by the arrows) or by exercising backward-directed propulsion. This positions the drive motor 12 in the best possible position in the operating position until the drive motor 12 collides with an obstacle and the overload protection allows a pivot movement into the tilt position to compensate for an impact of the obstacle, for example a stone (as schematically shown in FIG. 3B) on the drive motor 12. Following the collision with the obstacle the overload protection can be activated once more, for example, by switching the switchable fixing device 28.

FIG. 3B shows the drive motor after the same has collided with an obstacle (for example a stone) under water. In some embodiments, the force acting on the drive motor via the obstacle is such that the overload protection allows a pivot movement of the receiving device 26 in the direction of the tilt position (indicated by the curved arrow). FIG. 3C shows the drive arrangement 10 in the tilt position.

In some embodiments, the transport position is a position of the drive arrangement 10 that is pivoted in a way that the drive motor 12 is not submersed in the water. The drive motor 12 is pivoted in a way that the drive motor 12 is arranged at approximately the same height, for example above a top 3 of the boat. Accordingly, the pivot movement of the receiving device 26 in the direction of the tilt position is a pivot movement that moves away from a boat end, for example a stern of the boat, i.e. when an external force acts on the drive motor 12 in such a way that a specific threshold value of a pivot moment is transferred to the drive motor and is exceeded. Damage to the drive motor can be prevented in this way.

In some embodiments, the drive arrangement 10 further has a lever element 18 with an activation element 22. The lever element 18 is for example connected with the shaft 16 or the receiving device 26 in such a way that the drive arrangement 10 can be pivoted around the pivot axis 15 into the tilt position through activating the activation element 22 (FIG. 3C). The drive motor can therefore be pivoted out of the water quickly and can be fixed, for example for making the boat ready for transport or ready for landing.

Figure 7A:
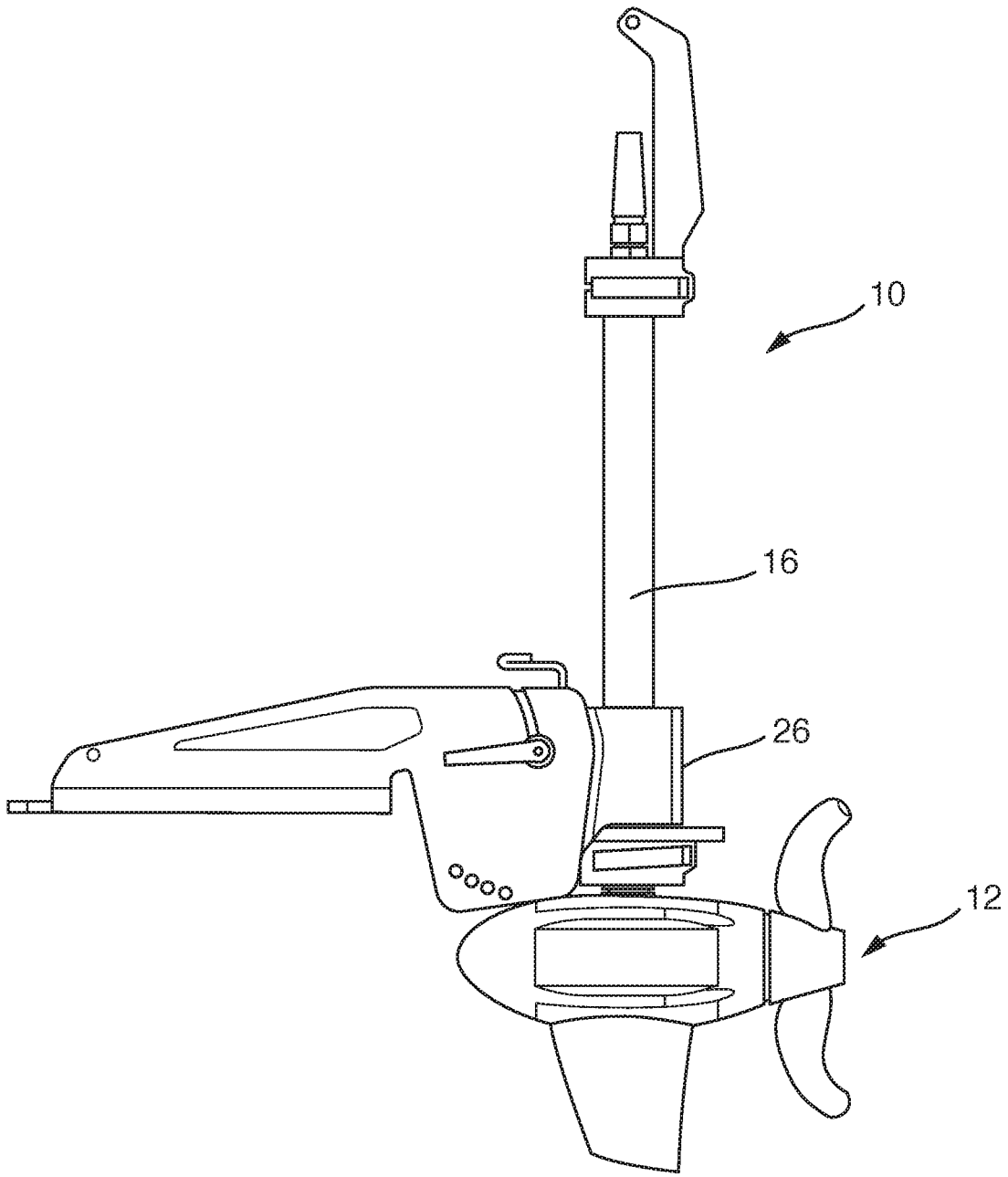
FIG. 7A and FIG. 7B are schematic views of the drive arrangement in a transport position.
Figure 7B:
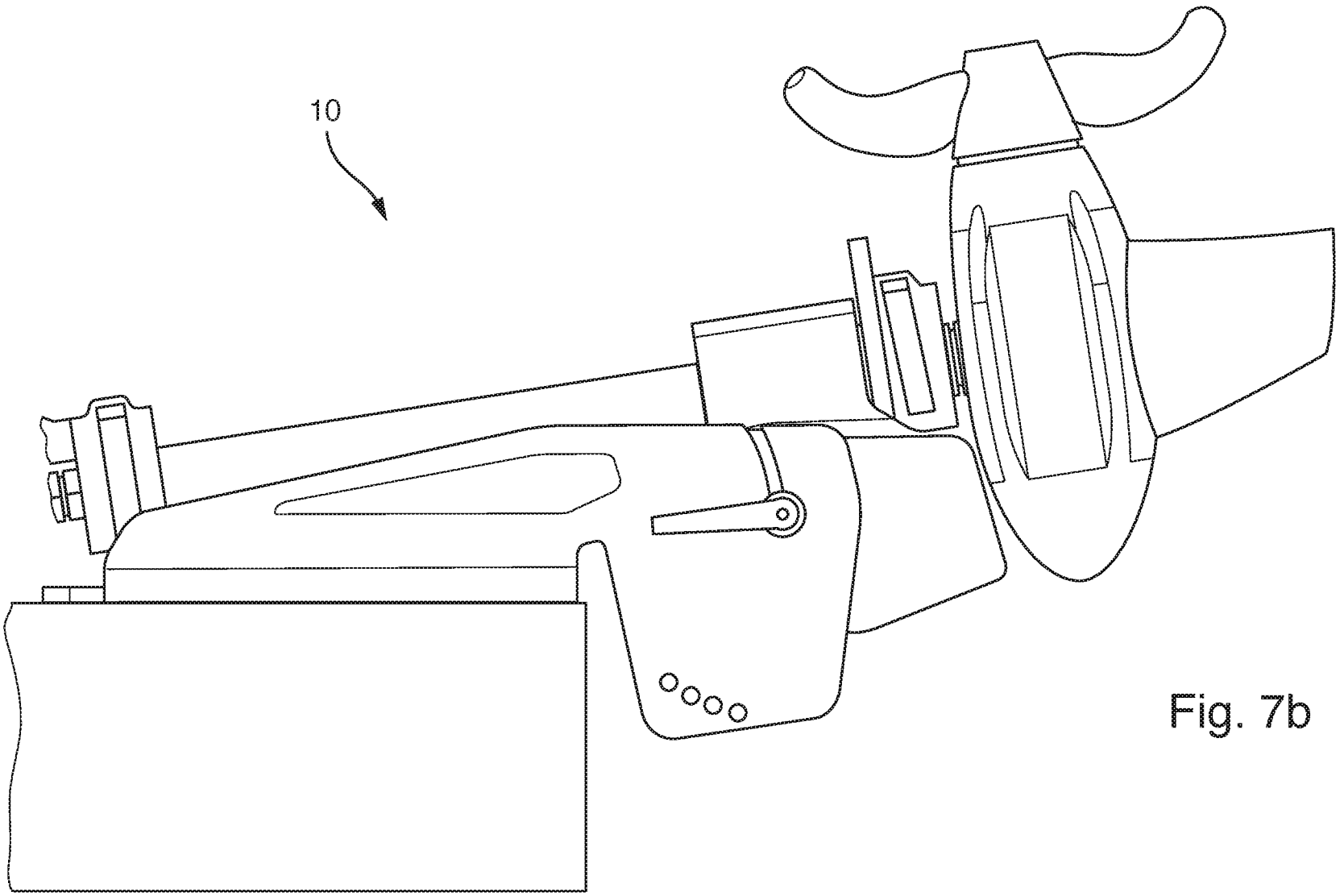

It is also possible to lift the drive arrangement 10 into a transport position (see FIGS. 7A-7B). The drive motor 12 can be first shifted upwards in the direction of the end of the shaft 16 in the direction of the receiving device 26, as shown in FIG. 7A, in such a way that the drive motor 12 lies as close as possible on the receiving device 26. The drive motor 12 can then be pivoted upwards into the transport position away from the water or earth surface (FIG. 7B) and can then be fixed for transport with a vehicle (not illustrated). This takes place manually and can be carried out without activating a rope element. The drive motor and the boat can therefore be lifted onto a trailer (not shown) quickly without disconnecting the drive motor from the boat for transport. This is very important especially for sports fishermen, as competitions are carried out across several water regions. Fast and safe transport without damage is therefore essential.

In some embodiments, the receiving device 26 is connected to the holder 14 with a quick-release lever and forms the pivot axis 15 in this way. The receiving device 26 can therefore be quickly disconnected from the holder 14 and stored in a place other than the fitted condition on a transport trailer in an alternative way.

Figure 4A:
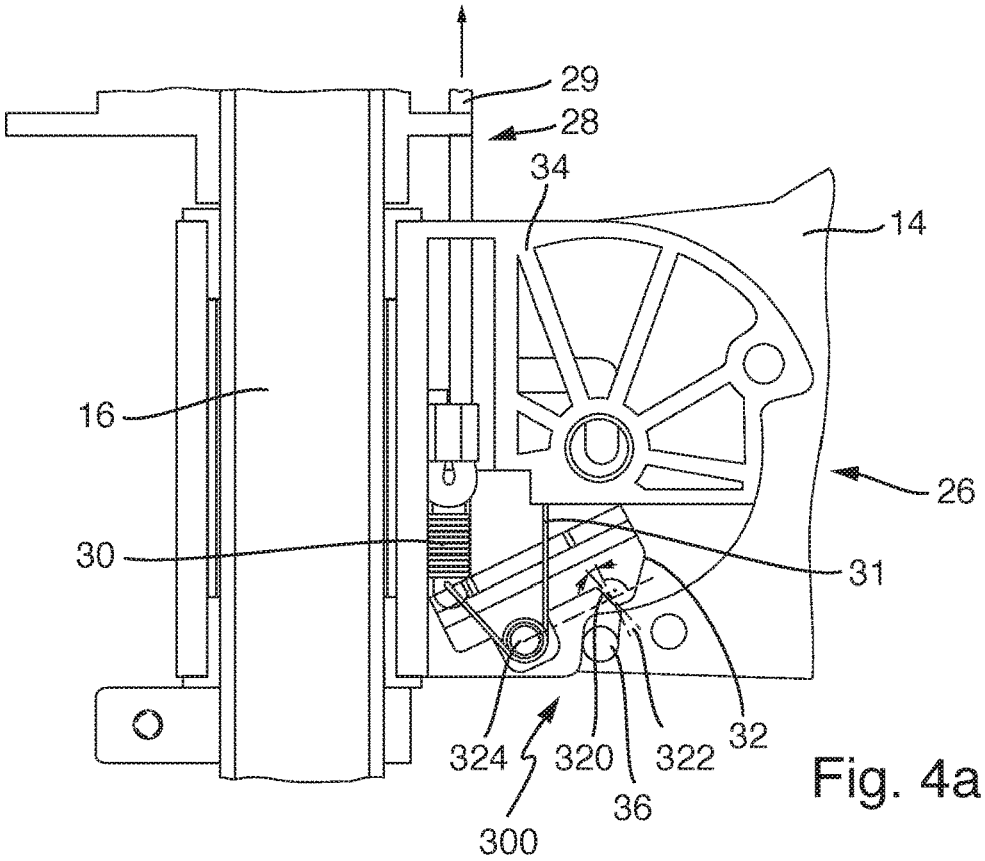
FIGS. 4A, 4B, 4C, 4D, 4E, 4F, and 4G are schematic detailed views of several embodiments of an overload protection of a fixing device in an operating condition according to some embodiments.
Figure 4B:
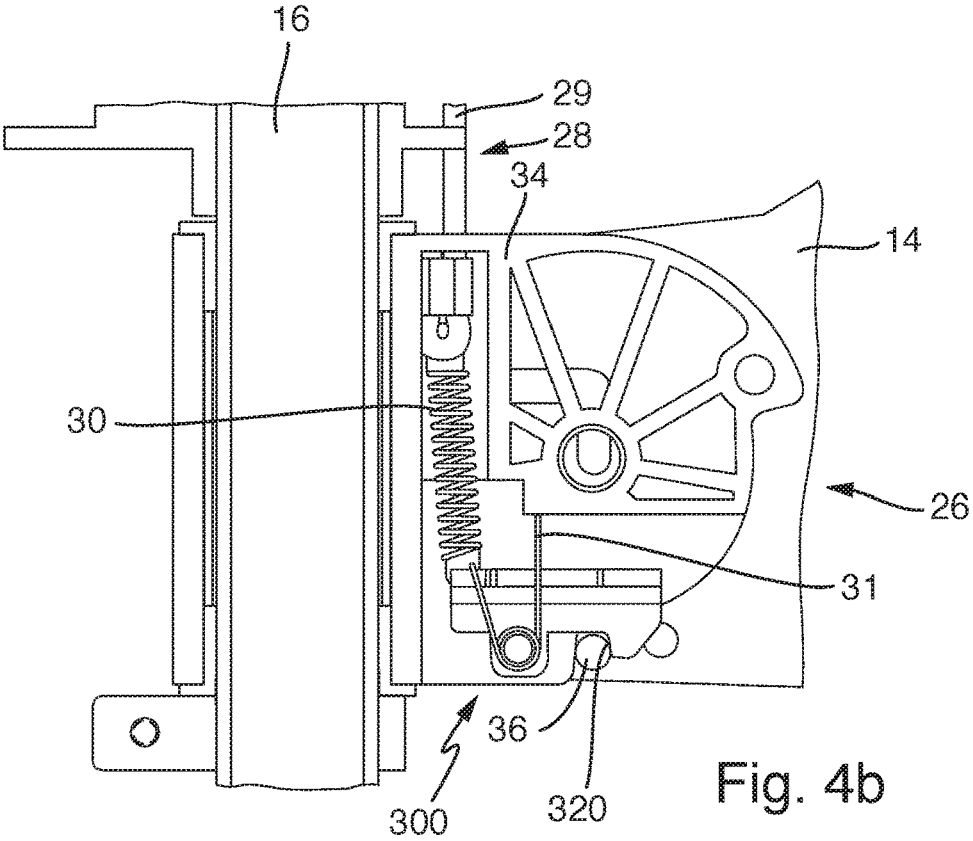

FIGS. 4A-4B show examples of an overload protection 300 of the switchable fixing device 28, which can be shifted into an operating position and automatically allows a pivot movement in the direction of the tilt position when a predetermined pivot movement of the drive motor arrangement 12 is exceeded. In some embodiments, the overload protection has a switching element 29, for example in the form of a fixing rope, an arresting lever 32 and an arresting bolt 36 adapted to the arresting lever 32. The arresting lever 32 is for example designed in a way that the arresting lever 32 arrests with the arresting bolt 36 in such a way when pulling the switching element 29 that the receiving device 26 can be shifted into the operating position and the electric drive motor 12 is therefore fixed against a pivot movement into the tilt position. The drive motor 12 is therefore ready for operation.

Figure 5C:
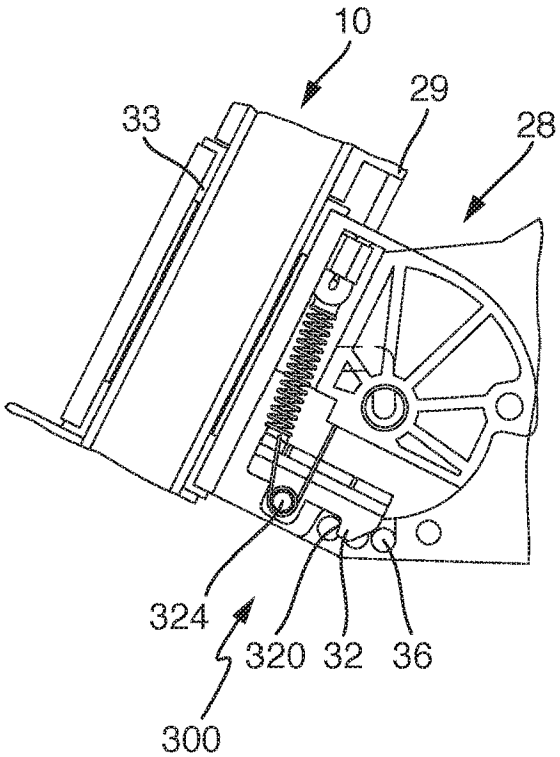
FIGS. 5A, 5B, and 5C are schematic views of the overload protection from FIGS. 4A and 4B during a pivot movement in the direction of the tilt position according to some embodiments.
Figure 5B:
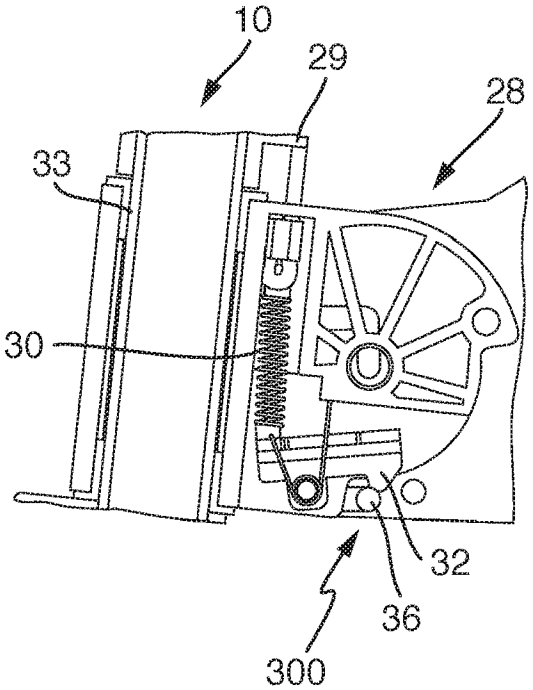

The arresting lever 32 is designed for forming the overload protection 300 in such a way that the arresting lever 32 disconnects from the arresting bolt 36 when the predetermined pivot force is exceeded and allows a pivot movement of the receiving device 26 into the tilt position (see FIG. 5B). In some embodiments, the arresting lever 32 is formed in a hook-shaped way.

In some embodiments, a spring element 30 is provided. An upper end of the spring element 30 is connected with the switching element 29 and a lower end of the spring element 30 is connected with the arresting lever 32. The spring element 30 can be tensioned by pulling the switching element 29 in such a way (FIG. 4B) that the arresting lever 32 arrests with the arresting bolt 36. The spring element is for example designed as a helical spring. The predetermined pivot force can be set in a very simple and precise way by selecting the spring element and the spring strength (for example a force that is just greater than the propulsion force during backward operation) from which the overload protection 300 is triggered, i.e. allows a pivot movement of the receiving device in the direction of the tilt position. The spring element 30 allows the arresting lever 32 to move counter to the spring pretensioning against its arresting position with the arresting bolt 36 when a corresponding force is applied to the same.

This force can be generated with a special design of the arresting flank 320 of the arresting lever 32 designed as an arresting hook. This arresting flank 320 is designed in a way that a force component acts in opening direction when the arresting lever 32 is submitted to a force through pivoting the drive motor 12. The arresting flank 320 is provided with an angle that supports such a force component acting in opening direction for this, for example a chamfering at an angle 322 of 1° to 5° to the tangential t with regard to the pivot axis 324 of the arresting lever 32. The tangential t stands vertically on the radial r in relation to the pivot axis 324 of the arresting lever 32.

In some embodiments, the arresting lever 32 is elastically and directly connected with the switching element 29 without an interconnected spring element, wherein the arresting lever 32 can be moved through activating the switching element 29 in such a way that the arresting lever 32 interlocks with the arresting bolt 36. The arresting lever 32 is deformable in such a way when the predetermined pivot force is exceeded that the arresting lever 32 disconnects from the arresting bolt. In some embodiments, the arresting lever is made from a rubber-like material, for example a neoprene material. The trigger force of the overload protection can be set by means of the elasticity of the rubber-like material. The force of triggering can further be set by means of the thickness and the shore hardness of the elastic material.

Figure 4C:
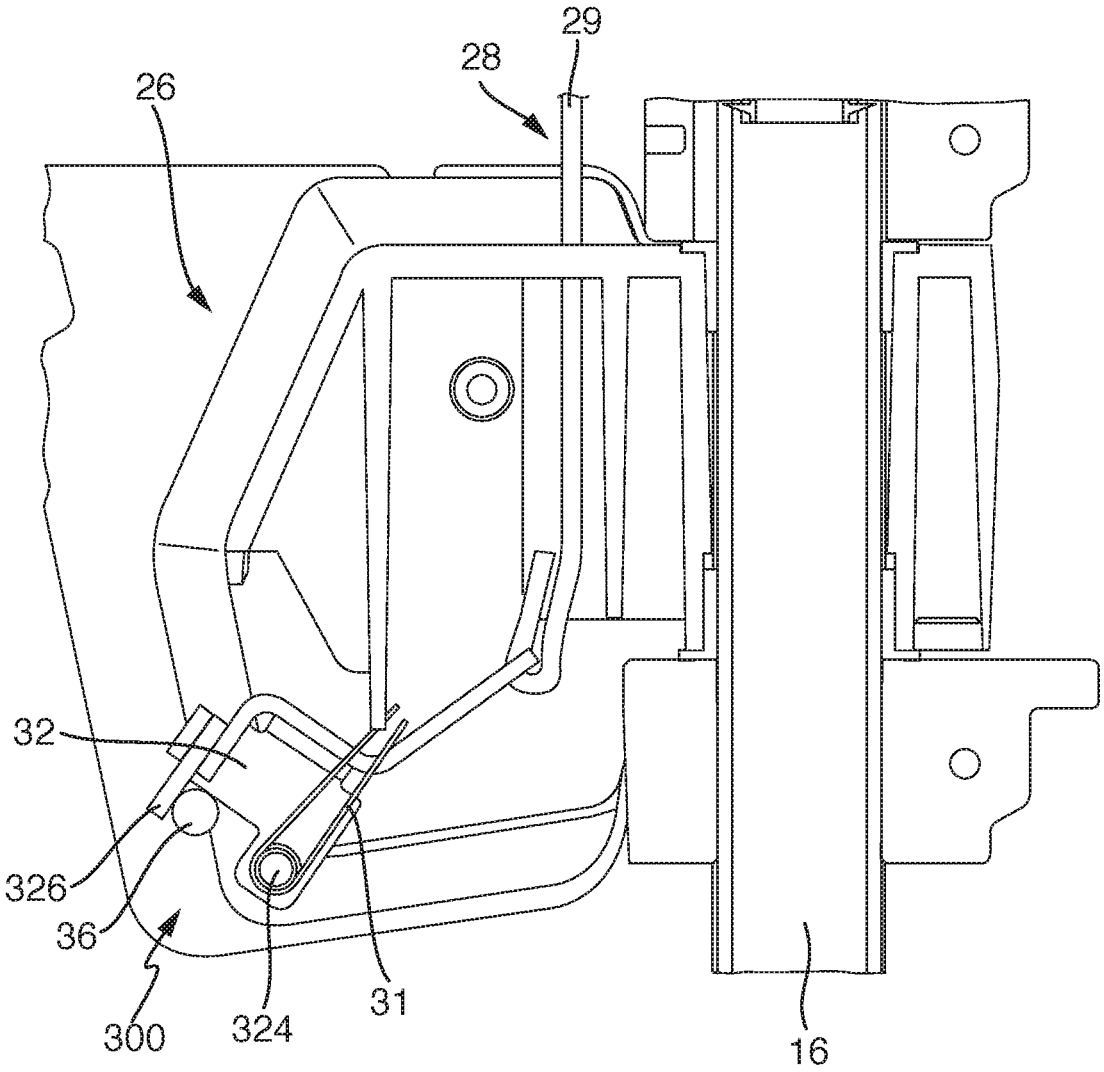
Figure 4D:
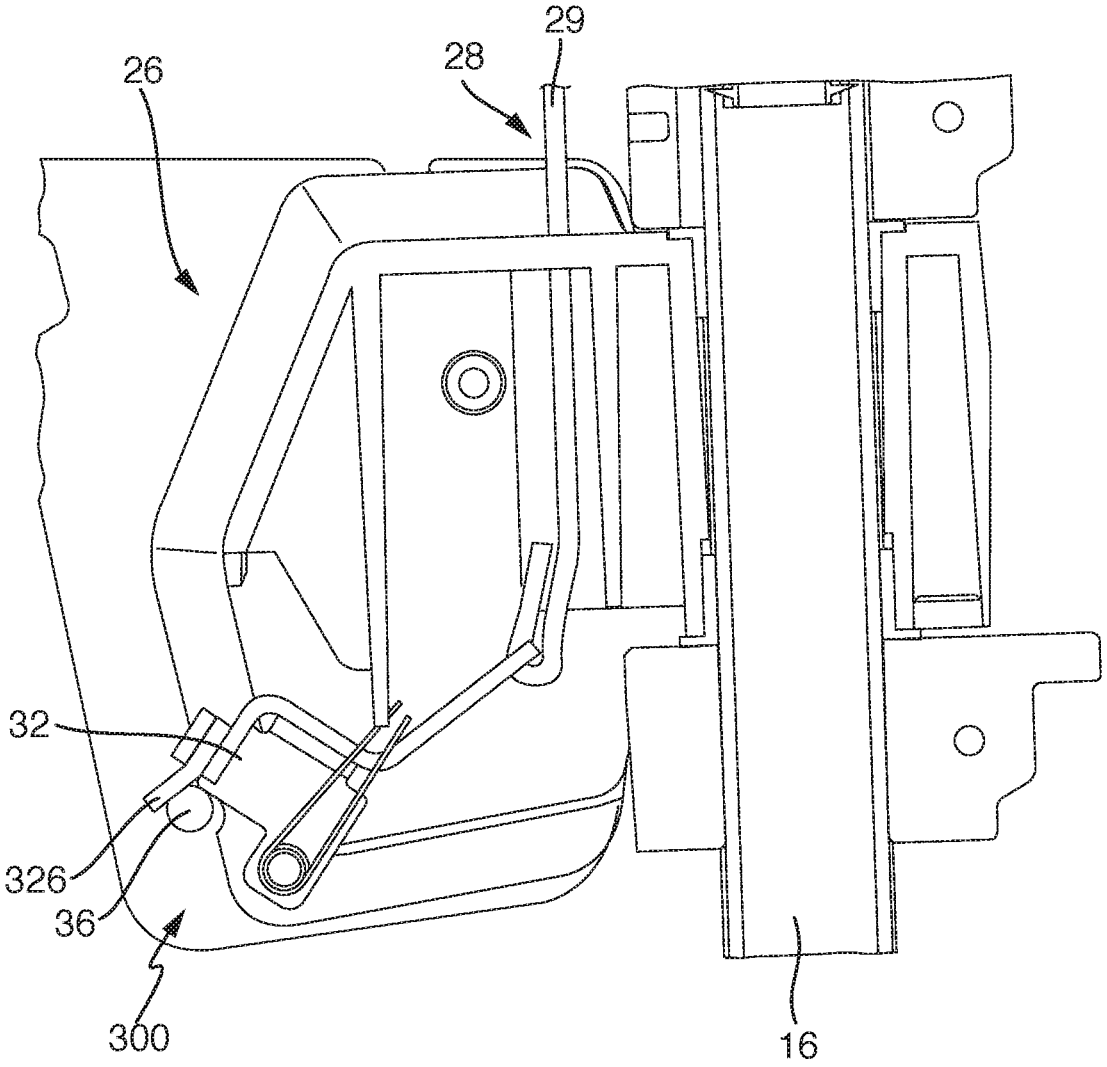
Figure 4E:
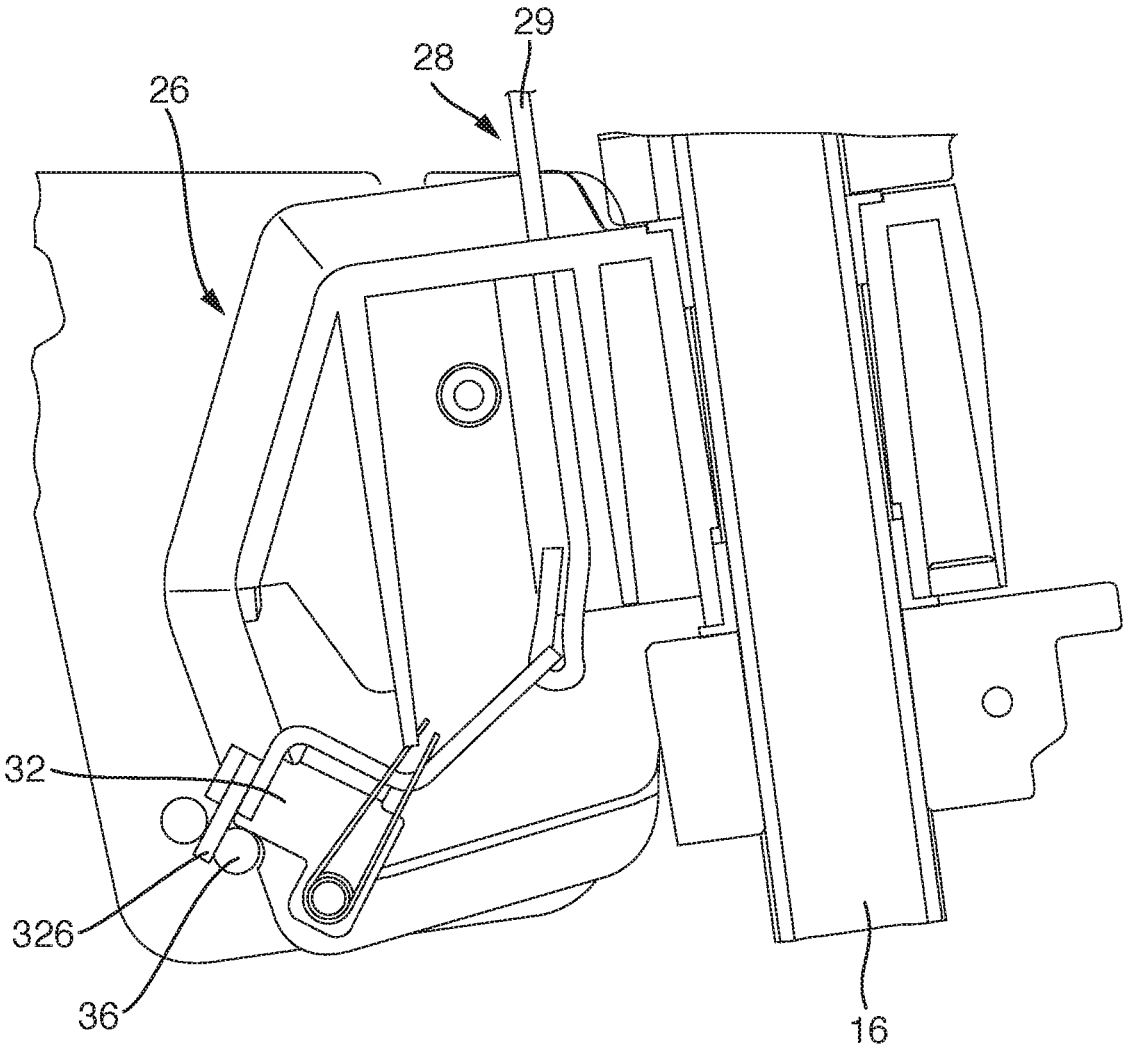

In some embodiments shown in FIGS. 4C-4E, at least one spring steel sheet 326 is arranged on the arresting lever 32 for providing the overload protection. The arresting lever 32 is connected with the switching element 29 via a connection element. The force of triggering can be varied with the spring stiffness of the spring steel sheet 326. The overload protection 300 is illustrated in the operating position in FIG. 4C. In FIG. 4D, the overload protection is loaded, so that the spring steel sheet 326 is deformed in a way where it will no longer engage the arresting bolt 36 when a predetermined threshold value is exceeded and allows a pivot movement of the drive arrangement 10 into the tilt position. This is shown in FIG. 4E. In some embodiments, the spring steel sheet 326 can also be replaced with a rubber-like material.

Figure 4F:
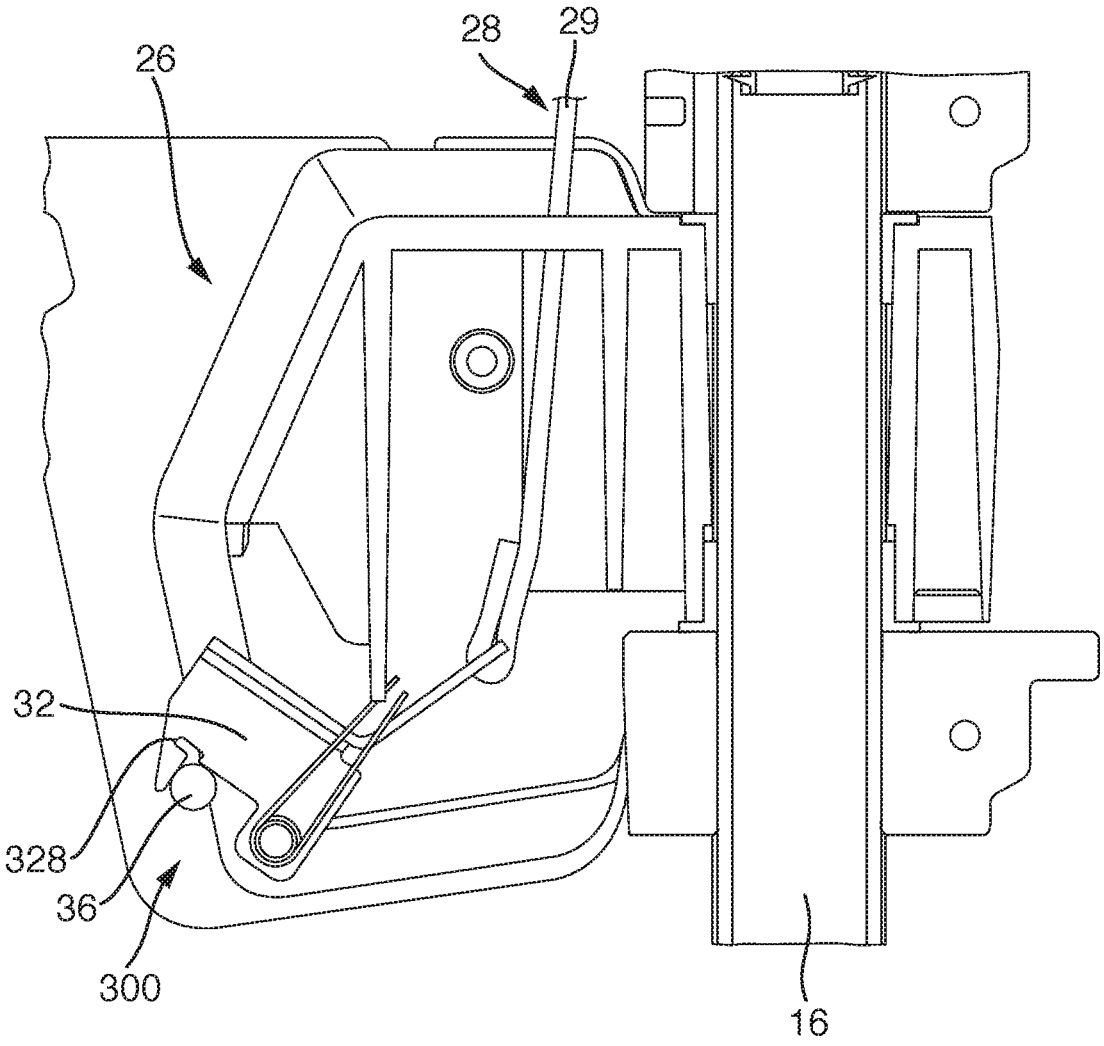
Figure 4G:
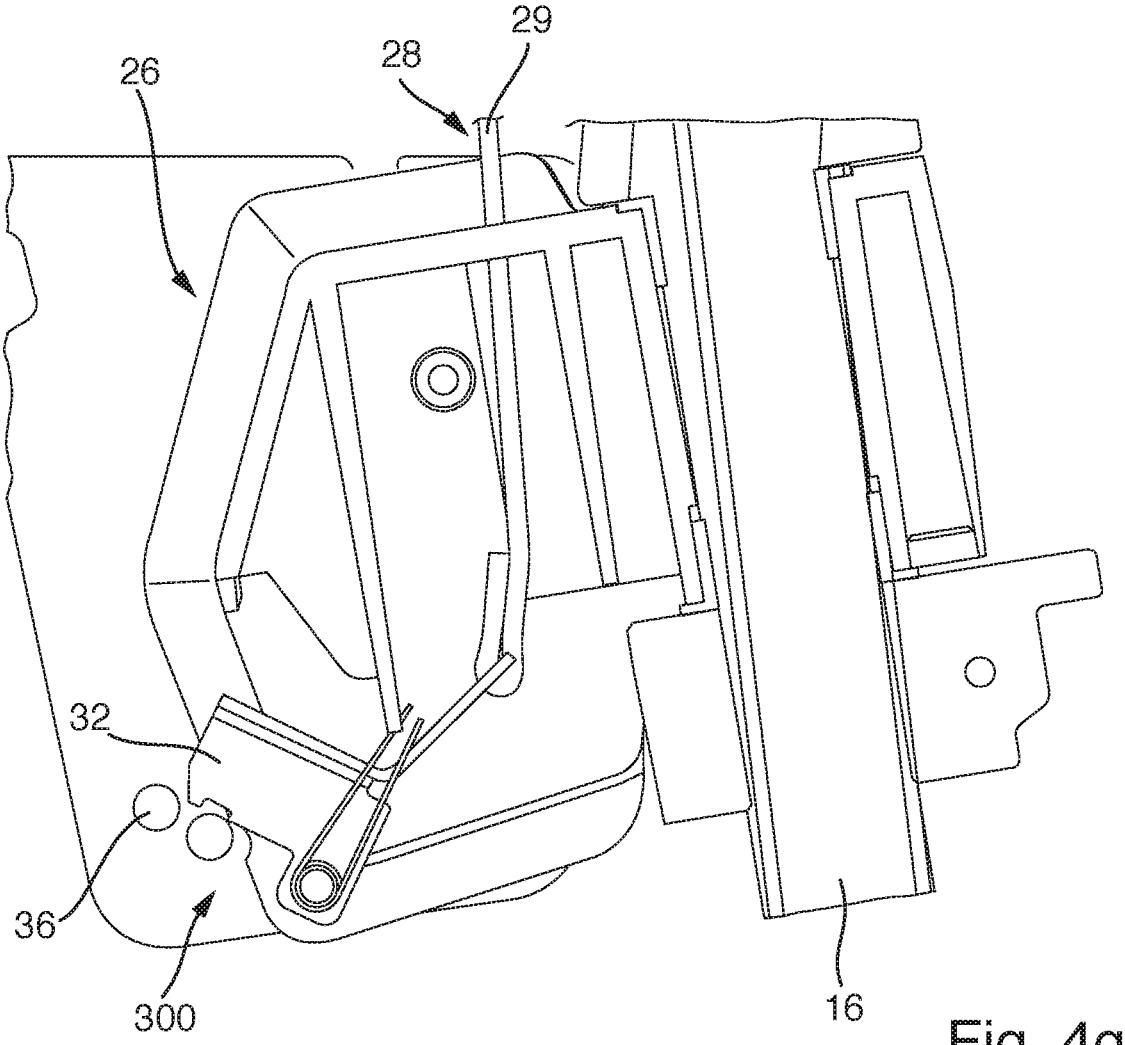

In some embodiments as shown in FIGS. 4F-4G, a triggering of the overload protection 300 can also be ensured by device of a predetermined breaking point 328 in the arresting lever 32. The arresting lever 32 is connected with the switching element 29 via a connection element. If a threshold value predetermined by the design of the predetermined breaking point 328 is exceeded, the arresting lever 32 will break at the predetermined breaking point 328 and allow a pivot movement of the drive position into the tilt position, as shown in FIG. 4G.

Figure 5A:
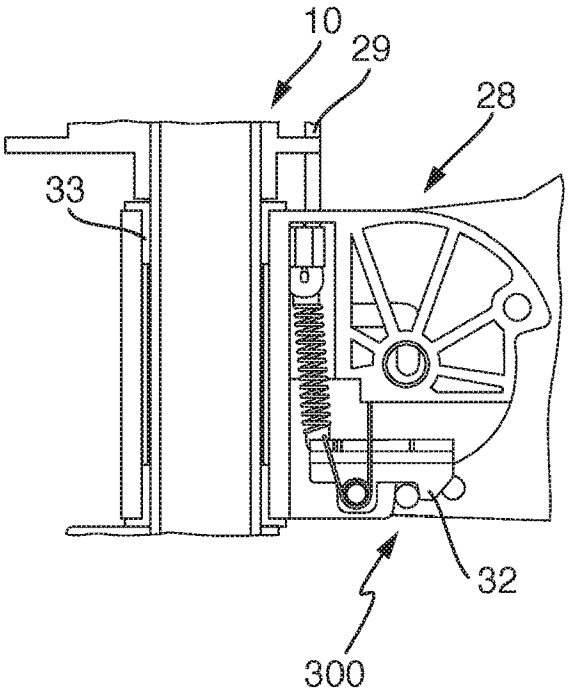

FIGS. 5A-5C show a series of schematic views of the overload protection 300 of the fixing device, which allows a pivot movement in the direction of the tilt position once the predetermined pivot force is exceeded. The arresting lever 32 is arrested or tensioned in the arresting bolt with the spring element 30 in FIG. 5A. This represents the operating position of the drive motor arrangement 10. FIG. 5B shows how the arresting lever 32 disconnects from the arresting bolt 36 after a part of the drive motor 12, for example the propeller 20, has collided with an obstacle under the water surface (not shown). The spring element 30 is designed in such a way that the spring element 30 is compressed so far from a predetermined pivot force that the arresting lever 32 disconnects from the arresting bolt 36. FIG. 5B shows how the arresting lever 32 is pulled in the direction of the tilt position behind the arresting bolt 36 by the pivot movement. The switching element 29 can be activated once more to return the drive motor arrangement 10 into the operating position.

FIGS. 6A-6C shows the drive arrangement 10 fitted to a top of the stern with a holder. Angle α is adjustable between one side of the holder 14*a*', 14*b*' in longitudinal direction of the boat 1 and the longitudinal axis 17 of the shaft 16 for setting the holder 14 to an incline of a fitting area of the boat in such a way that the shaft 16 stands almost vertical in relation to a water surface. Boats, in particular kayaks, very often have no level stern areas. To guarantee an optimal position of the drive motor or the propeller the incline of the stern area must be compensated, as a right-angled arrangement of shaft and holder would otherwise mean that no optimal position of the drive motor or the propeller in the water can be achieved. The optimal position of the propeller is a position of the propeller that applies a forward propulsion force to the boat in an operating condition, which is substantially parallel to the water surface.

FIG. 6D shows an enlarged section of the holder 14, which has at least one recess 40 on at least one holding arm 14*a*, 14*b*, wherein a trim bolt 38 is connected on the housing of the fixing device (FIGS. 6A-6C) and is designed for engaging the at least one recess 40. In some embodiments, several recesses 40 are arranged in a way that angle α between the side of the holder 14*a*', 14*b*' is adjustable in longitudinal direction of the boat and the shaft 16 through adjusting and/or repositioning the trim bolt into one of the recesses 40 for angle α to be set. The drive motor arrangement can therefore be adapted to the incline of a boat end, so that the drive motor is optimally positioned in the water irrespective of the incline of the boat end. Angle α is for example adjustable within an angle range of between 80° and 120°, preferably 90°-114°.

FIGS. 6A-6C further show a section (stern) of the boat 1, in particular a kayak, with a drive arrangement by way of example. The boat 1 has a fitting area 3, in which the drive arrangement 10 can be fitted to the boat. In one example (not shown) the fitting area is simultaneously a device for fitting an anchor, for example a motor-driven or manually drivable shallow water anchor in the form of an anchor post.

Where applicable, all individual characteristics illustrated in the embodiment example can be combined with and/or exchanged for each other without departing from the scope of the disclosure.

All patents, patent applications, and published references cited herein are hereby incorporated by reference in their entirety. It will be appreciated that several of the above-disclosed and other features and functions, or alternatives thereof, may be desirably combined into many other different systems or application. Various alternatives, modifications, variations, or improvements therein may be subsequently made by those skilled in the art.

The invention claimed is:

1. A drive arrangement for propelling a boat comprising:

an electric drive motor with a shaft and a receiving device for receiving the shaft, wherein the receiving device is designed for pivoting the electric drive motor between an operating position and a tilt position; and a switchable fixing device that is provided for fixing the receiving device in the operating position, wherein the fixing device has an overload protection for disconnecting the fixing device in the operating position when a predetermined pivot force in a direction of the tilt position is exceeded and wherein the fixing device has an arresting lever and an arresting bolt, wherein the arresting lever engages the arresting bolt for fixing.

2. The drive arrangement according to claim 1, wherein the shaft is connected with the receiving device in such a way that the shaft can be rotated around a longitudinal axis of the shaft.

3. The drive arrangement according to claim 1, wherein the receiving device is pivotably connected to a holder between two holding arms of the holder, so that the receiving device can be pivoted around a pivot axis.

4. The drive arrangement according to claim 3, wherein the receiving device has a housing that is fitted to the holder between the two holding arms of the holder along the pivot axis, so that the receiving device can be pivoted around the pivot axis.

5. The drive arrangement according to claim 1, wherein a switching element is provided and the arresting lever can be engaged with the arresting bolt through activating the switching element in such a way that the receiving device is locked in the operating position, wherein the overload protection is formed by means of a design of the arresting lever in such a way that the arresting lever disconnects from the arresting bolt when a predetermined pivot force is exceeded, wherein the arresting lever has a correspondingly designed arresting flank, which forces the arresting lever out of engagement with the arresting bolt when a predetermined pivot force is exceeded.

6. The drive arrangement according to claim 5, wherein the overload protection of the fixing device comprises a pretensioning device for the arresting lever, wherein a spring element is provided and the switching element acts on the arresting lever via the spring element.

7. The drive arrangement according to claim 1, wherein the overload protection of the fixing device comprises an elastically designed arresting flank of the arresting lever, wherein the elastically designed arresting flank can be deformed in such a way that the arresting lever disconnects from the arresting bolt when the predetermined pivot force is exceeded.

8. The drive arrangement according to claim 1, wherein an angle α between one side of a holder for holding the receiving device on the boat in a longitudinal direction of the boat and the longitudinal axis of the shaft is adjustable for setting the holder to an incline of a fitting area of the boat in such a way that the shaft stands almost vertical in relation to a water surface.

9. The drive arrangement according to claim 1, wherein the boat is a kayak.

10. A boat comprising:

a drive arrangement comprising:

an electric drive motor with a shaft and a receiving device for receiving the shaft, wherein the receiving device is designed for pivoting the electric drive motor between an operating position and a tilt position;

a switchable fixing device that is provided for fixing the receiving device in the operating position, wherein the fixing device has an overload protection for disconnecting the fixing device in the operating position when a predetermined pivot force in a direction of the tilt position is exceeded; and a fitting area on a top of a boat end to which the drive arrangement can be fitted, wherein the fixing device has an arresting lever and an arresting bolt, wherein the arresting lever engages the arresting bolt for fixing.

11. The boat according to claim 10, wherein the boat is a kayak.

* * * * *